US006050862A

United States Patent [19]

Ishii

[11] Patent Number: 6,050,862

[45] Date of Patent: Apr. 18, 2000

[54] FEMALE TERMINAL WITH FLEXIBLE CONTACT AREA HAVING INCLINED FREE EDGE PORTION

[75] Inventor: Takashi Ishii, Shizuoka, Japan

[73] Assignee: Yazaki Corporation, Tokyo, Japan

[21] Appl. No.: 09/081,570

[22] Filed: May 19, 1998

[30] Foreign Application Priority Data

May 20, 1997 [JP] Japan ..... 9-129911

[51] Int. Cl.[7] ..... H01R 13/187

[52] U.S. Cl. ..... 439/843; 439/852

[58] Field of Search ..... 439/843, 845, 439/844, 852, 851, 862

[56] References Cited

U.S. PATENT DOCUMENTS 5,427,553 6/1995 Tsuji ..... 439/851
5,601,458 2/1997 Ohsumi et al. ..... 439/852

FOREIGN PATENT DOCUMENTS 7-106011 4/1995 Japan .
8-330009 12/1996 Japan .

*Primary Examiner*—Michael L. Gellner
*Assistant Examiner*—Barry M. L. Standig
*Attorney, Agent, or Firm*—Armstrong, Westerman, Hattori, McLeland and Naughton

[57] ABSTRACT

A low inserting force terminal is provided. An elastic contact arm for a male terminal is formed inside the electrical contact unit, and the free edge portion of the elastic contact portion is slidable along the inner wall of the electrical contact unit. An inclined surface which is inclined in the sliding direction of the free edge portion is formed on the inner wall. The free edge portion is situated at the front edge of the inclined surface when the male terminal is in a non-inserted state. A contact surface for preventing excessive displacement of the elastic contact arm is formed at the rear edge of the inclined surface.

5 Claims, 3 Drawing Sheets

FIG. 1
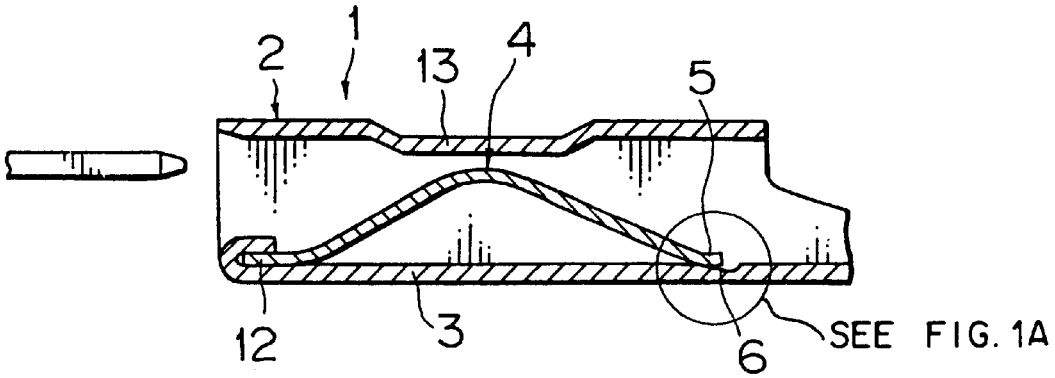
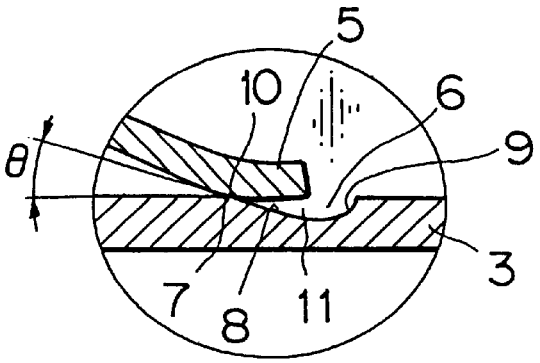
FIG. 1A
FIG. 2
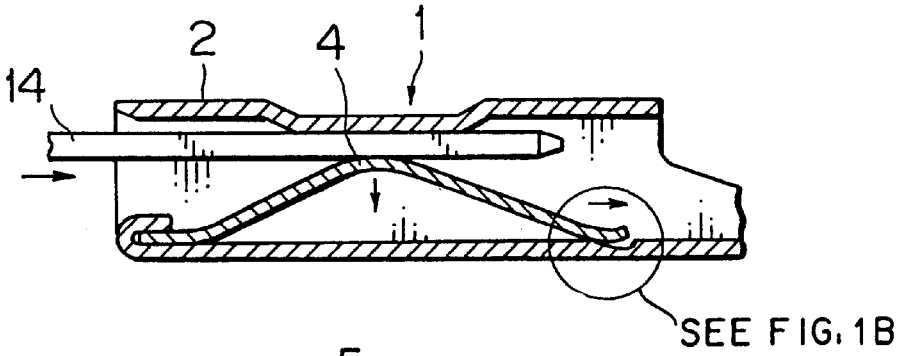
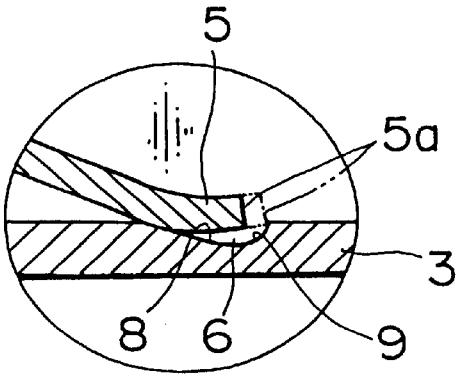
FIG. 1B

FIG. 3
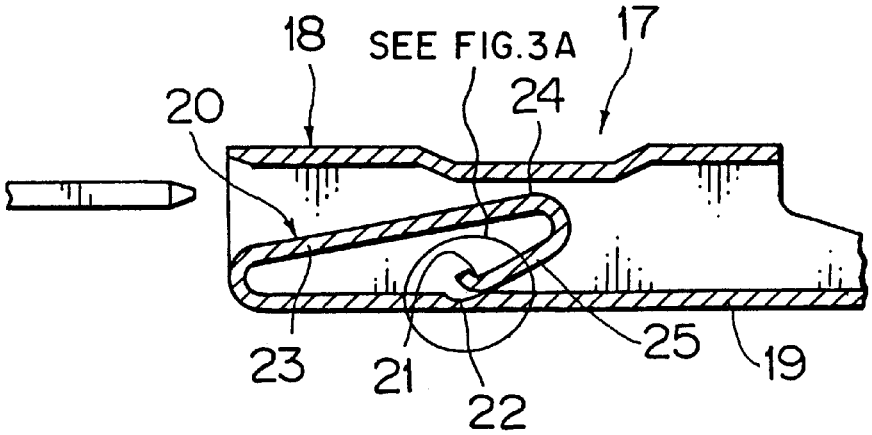
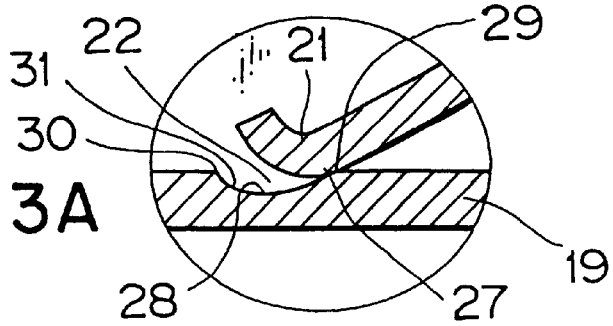
FIG. 3A
FIG. 4
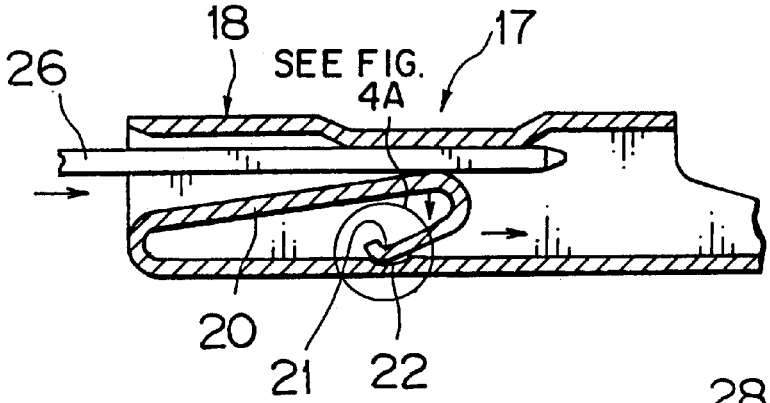
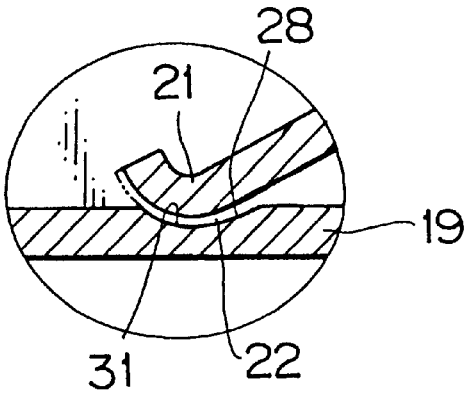
FIG. 4A

FEMALE TERMINAL WITH FLEXIBLE CONTACT AREA HAVING INCLINED FREE EDGE PORTION

BACKGROUND OF THE INVENTION

1. Field of the Invention

The present invention relates to a low inserting force terminal whose elastic contact arm is made slidable along the inner wall of the electrical contact unit so as to reduce inserting force of a mating terminal.

2. Related Art

FIGS. 5 and 6 show a terminal of the prior art (disclosed in Japanese Patent Application Laid-Open No. 7-106011, for instance).

As shown in FIG. 5, the terminal 35 comprises a box-like electrical contact unit 36 and an elastic contact arm 37 separately formed inside the electrical contact unit 36. A wire joining portion (not shown) is formed at the rear end of the electrical contact unit 36.

A first edge 39 of the elastic contact arm 37 is secured to the bottom wall 38 of the electrical contact unit 36. As a mating male terminal 41 is inserted into the electrical contact unit 36, a second edge (free edge portion) 40 of the elastic contact arm 37 slides rearward along the bottom wall 38, as shown in FIG. 6. As the elastic contact arm 37 bends downward (i.e., toward the bottom wall 38) due to the pressure from the male terminal 41, the free edge portion 40 of the elastic contact arm 37 slides along the bottom wall 38. The male terminal 41 is then interposed between the elastic contact arm 37 and the top wall 42 of the electrical contact unit 36, so that the female terminal 35 and the male terminal 41 are electrically connected.

With the above terminal 35 of the prior art, however, there has been a problem that the free edge portion 40 of the elastic contact arm 37 causes large frictional resistance with the bottom wall 38 of the electrical contact unit 36. As a result of this, the inserting force of the male terminal 41 becomes higher, and workability in terminal insertion gets worse.

SUMMARY OF THE INVENTION

The principal object of the present invention is to provide a low inserting force terminal to avoid deterioration of terminal insertion workability due to the sliding of the free edge portion of the elastic contact arm.

The low inserting force terminal of the present invention comprises an elastic contact arm for a male terminal inside the electrical contact unit. The free edge portion of the elastic contact arm is slidable along the inner wall of the electrical contact unit. An inclined surface which is inclined in the sliding direction of the free edge portion is formed on the inner wall.

The free edge portion is situated at the front edge of the inclined surface when the male terminal is in a non-inserted state. A contact surface for preventing excessive displacement of the elastic contact arm is formed at the rear edge of the inclined surface.

In accordance with a first aspect of the present invention, since the free edge portion of the elastic contact arm slides along the inclined surface on the inner wall as if falling at the time of connecting to the mating terminal, frictional resistance between the free edge portion and the inner wall can be reduced, as well as the inserting force of the mating terminal. Thus, workability in terminal insertion can be improved.

In accordance with another aspect of the present invention, since the free edge portion starts sliding along the inclined surface when it starts moving, the inserting force can be reduced further.

In accordance with yet another aspect of the present invention, if the elastic contact arm is excessively displaced, the free edge portion is brought into contact with the inclined contact surface so as to prevent further displacement.

The above and other objects and features of the present invention will be more apparent from the following description taken in conjunction with the accompanying drawings.

BRIEF DESCRIPTION OF THE DRAWINGS

FIG. 1 is a vertical sectional view (partially enlarged) of one embodiment of a low inserting force terminal in accordance with the present invention.

FIG. 2 is a vertical sectional view illustrating the low inserting force terminal in a terminal inserted state.

FIG. 3 is a vertical sectional view of another embodiment of a low inserting force terminal in accordance with the present invention.

FIG. 4 is a vertical sectional view illustrating the low inserting force terminal in a terminal inserted state.

DETAILED DESCRIPTION OF THE PREFERRED EMBODIMENTS

Figure 5:
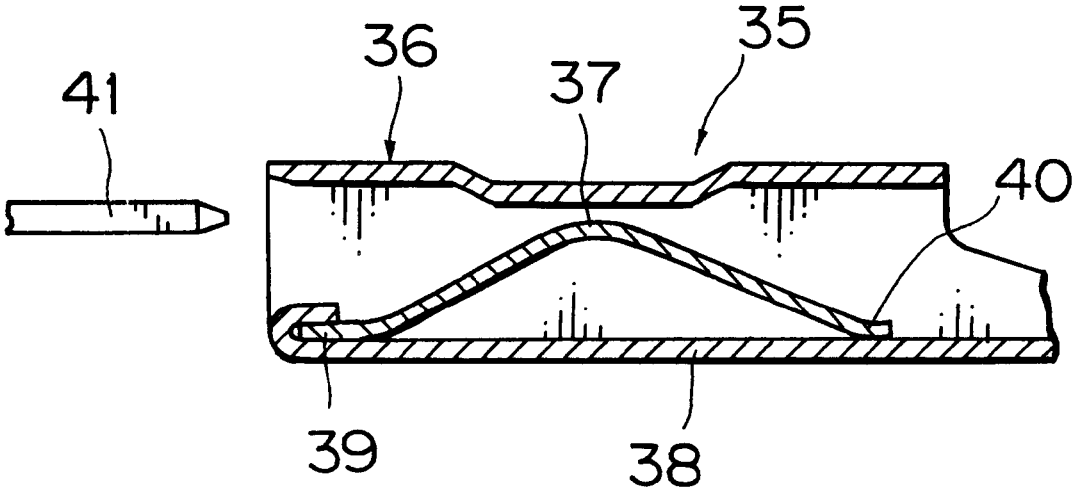
FIG. 5 PRIOR ART
FIG. 5 is a vertical sectional view illustrating a terminal of the prior art.
Figure 6:
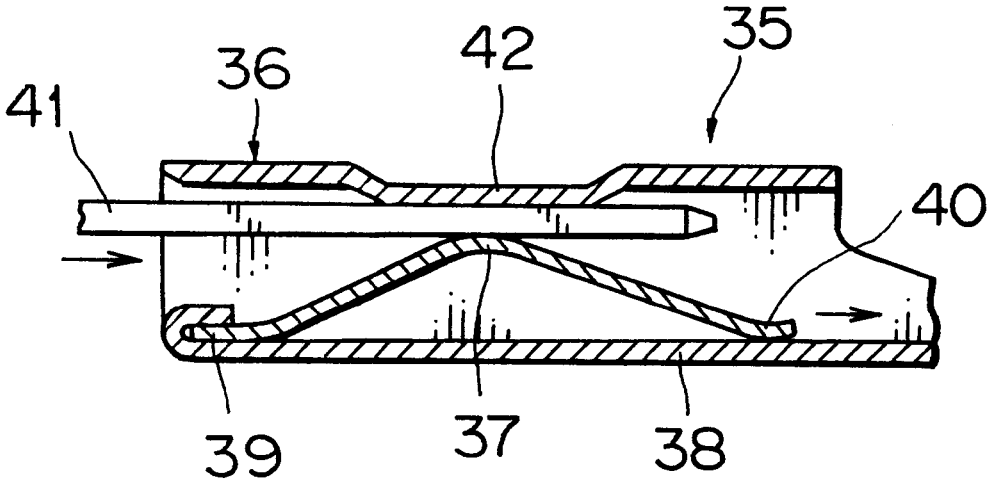
FIG. 6 PRIOR ART
FIG. 6 is a vertical sectional view illustrating the low inserting force terminal of the prior art in a terminal inserted state.

The following is a detailed description of embodiments of the present invention with reference to the accompanying drawings.

FIGS. 1 and 2 show one embodiment of a low inserting force terminal according to the present invention.

As shown in FIG. 1, the low inserting force terminal (female terminal) 1 is characterized by having an inclined recess 6 with which the free edge portion 5 of an elastic contact arm 4 is brought into contact on the bottom wall (inner wall) 3 of a box-like electrical contact unit 2. The recess 6 is formed by press molding, for instance, during the process of stamping the terminal.

The recess 6 is situated on the rear side of the contact point 7 of the elastic contact arm 4 with the bottom wall 3. The recess 6 has an inclined slide surface 8 at an angle θ of approximately 15°. The inclined surface 8 is inclined downwardly in the sliding direction of the free edge portion 5 of the elastic contact arm 4, and extends to an upwardly inclined contact surface 9 which is inclined at a large angle at the rear end of the recess 6. The inclined groove 6 is largely formed by the gently-sloped inclined surface 8. The width of the recess 6 (i.e., the length in the width direction of the terminal) is made slightly greater than the width of the elastic contact arm 4. The contact point 7 of the elastic contact arm 4 is situated at the front edge 10 of the inclined surface 8, whereas the free edge portion 5 of the elastic contact arm 4 is situated above the inclined surface 8 keeping a clearance 11.

A first edge 12 of the elastic contact arm 4 is secured at the front end of the bottom wall 3 as in the prior art. The elastic contact arm 4 bends like an arch, and the free edge portion 5 of the elastic contact arm 4 is slidably in contact with the bottom wall 3. The top wall 13 of the electrical contact unit 2 faces the top portion of the elastic contact arm 4. The rear end of the bottom wall 3 leads to a wire joining portion (not shown).

As shown in FIG. 2, when a mating male terminal 14 (or the tab-like electrical contact unit of a male terminal, to be exact) is inserted into the electrical contact unit 2 of the female terminal 1, the elastic contact arm 4 bends downward, and the free edge portion 5 slides diagonally downward along the inclined surface 8. As the free edge portion 5 slips into the recess 6, it can be smoothly moved rearward with very little small force, thereby reducing the inserting force of the male terminal 14.

The rearward movement of the free edge portion 5 is very small. When the insertion of the male terminal 14 is completed, the free edge 5*a* stops just before coming into contact with the inclined contact surface 9. The length of the recess 6 is specified such that the free edge 5*a* is not brought into contact with the inclined contact surface 9 at the time of normal terminal insertion. By doing so, the spring constant of the elastic contact arm 4 at the time of normal insertion of the male connector 14 can be kept constant. Thus, the inserting force of, and the contact pressure on, the male terminal 14 can be stabilized.

If the elastic contact arm 4 is ever displaced downward or rearward beyond an allowable range, the free edge 5*a* is brought into contact with the inclined contact surface 9, as indicated by the chain line in the figure, so as to prevent further displacement. By doing so, the spring force of the elastic contact arm 4 can be maintained, and the contact between the elastic contact arm 4 and the male terminal 14 can be stabilized. If further displacement occurs, the free edge portion 5 goes beyond the inclined contact surface 9, thereby preventing deformation of and damage to the elastic contact am 4.

FIGS. 3 and 4 show another embodiment of the low inserting force terminal of the present invention.

The low inserting force terminal 17 is characterized by comprising a loop-like elastic contact arm 20 which is integrally formed on the bottom wall 19 of a box-like electrical contact unit 18, and a recess 22 formed in a position where the free edge portion 21 of the elastic contact arm 20 is brought into contact with the bottom wall 19. The recess 22 extends forward from the rear of the bottom wall 19.

The elastic contact arm 20 stands diagonally from the front edge of the bottom wall 19 (as indicated by reference numeral 23), bends forward at the contact point 24 (as indicated by reference numeral 25), and leads to the free edge portion 21. The free edge portion 21 bends at the center with both sides extending upward. When a male terminal 26 (shown in FIG. 4) is in a non-inserted state, the bent portion 27 is situated at, or slightly displaced from, the front edge 29 of the inclined surface 28 of the inclined groove 22. The surface 28 inclines slightly downward. It may also be tapered as shown in FIG. 1. An inclined contact surface 31 is formed at the rear end of the inclined groove 22.

As shown in FIG. 4, as the male terminal 26 is inserted into the electrical contact unit 18, the elastic contact arm 20 bends downward, and the free edge portion 21 slides forward along the inclined surface 28. Since the free edge portion 21 is slippery, the elastic contact arm 20 can be displaced downward and moved forward with only small force. Thus, the inserting force of the male terminal 26 can be reduced.

With the male terminal 26 being in the normal inserted state, the free edge portion 21 of the elastic contact arm 20 is situated above the inclined contact surface 31 of the recess 22, maintaining a short distance from it. If the elastic contact arm 20 is displaced excessively, the free edge portion 21 is brought into contact with the inclined contact surface 31, as indicated by the chain line, to prevent further displacement.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A low inserting force terminal comprising:

an electrical contact unit;

an elastic contact arm for a male terminal disposed inside the electrical contact unit;

a free edge portion formed at an end of the elastic contact arm, the free edge portion being slidable along an inner wall of the electrical contact unit; and a recess formed on the inner wall of the electrical contact unit adjacent said free edge portion in a relaxed state of said contact arm, said recess being operative to receive said free edge portion and having an inclined surface inclined downwardly in the sliding direction of the free edge portion.

2. The low inserting force terminal according to claim 1, wherein the free edge portion is situated at a front end of the inclined surface when the male terminal is in a non-inserted state.

3. The low inserting force according to either one of claim 1 or claim 2, wherein a contact surface for preventing excessive displacement of the elastic contact arm is formed at a rear end of the inclined surface.

4. The low inserting force terminal according to claim 3, wherein the elastic contact arm is arch-shaped, and said contact surface is disposed to engage an edge surface of the free portion, if the elastic contact arm is excessively displaced.

5. The low inserting force terminal according to claim 3, wherein the elastic contact arm is loop-shaped, and the free edge portion is brought into contact with the contact surface of the recess, if the elastic contact arm is excessively displaced.

* * * * *